US005842167A

United States Patent [19]

Miyatake et al.

[11] Patent Number: 5,842,167

[45] Date of Patent: Nov. 24, 1998

[54] SPEECH SYNTHESIS APPARATUS WITH OUTPUT EDITING

[75] Inventors: Masanori Miyatake; Hiroki Ohnishi; Takeshi Yumura, all of Osaka; Shoji Takeda, Gifu; Masashi Ochiiwa, Gifu; Takashi Izumi, Gifu, all of Japan

[73] Assignee: Sanyo Electric Co. Ltd., Osaka, Japan

[21] Appl. No.: 653,075

[22] Filed: May 21, 1996

[30] Foreign Application Priority Data

May 29, 1995 [JP] Japan ..... 7-130773

[51] Int. Cl.[6] ..... G10L 5/02

[52] U.S. Cl. ..... 704/260; 704/276

[58] Field of Search ..... 395/2.7, 2.77, 395/2.87, 2.69, 2.44; 704/260, 261, 268, 278, 235, 276

[56] References Cited

U.S. PATENT DOCUMENTS

| | | | |
|---|---|---|---|
| 4,914,704 | 4/1990 | Cole et al. | 395/2.44 |
| 5,010,495 | 4/1991 | Willetts | 395/800 |
| 5,204,969 | 4/1993 | Capps et al. | 395/2.09 |
| 5,278,943 | 1/1994 | Gasper et al. | 395/2.09 |
| 5,555,343 | 9/1996 | Luther | 395/2.69 |
| 5,572,625 | 11/1996 | Raman et al. | 395/2.69 |

FOREIGN PATENT DOCUMENTS 2580565 3/1997 Japan .

OTHER PUBLICATIONS

Pitch–Synchronous Waveform Processing Techniques For Text–To–Speech Synthesis Using Diphones, By: Francis Charpentier, Etic Moulines, Proc. Euro Speech 89, No. 2, pp. 13–19.

*Primary Examiner*—David R. Hudspeth
*Assistant Examiner*—Susan Wieland
*Attorney, Agent, or Firm*—Darby & Darby

[57] ABSTRACT

A speech synthesis apparatus for synthesizing speech from text data, having a voice characteristic, a tone, a rhythm, etc. which corresponds to the contents of edition on the text data displayed on a screen, by converting a volume, a speed, a pitch, a voice characteristic, etc. of a voice on judging the contents of the edition, such as an edition of a size, a spacing, a font and so on of a character, on the text data displayed on a screen.

39 Claims, 4 Drawing Sheets

SPEECH SYNTHESIS APPARATUS WITH OUTPUT EDITING

BACKGROUND OF THE INVENTION

1. Field of the Invention

The present invention relates to a speech synthesis apparatus for specifying an output mode of a synthesized speech by means of visual operations on a screen, such as character edition and inputting of commands, which make the user intuitively imagine the output mode of the synthesized speech in an easy manner. The speech synthesis apparatus according to the present invention is used in applications such as an audio response unit of an automatic answering telephone set, an audio response unit of a seat reservation system which utilizes a telephone line for reserving seats for airlines and trains, a voice information unit installed in the station yard, a car announcement apparatus for subway systems and bus stops, an audio response/education apparatus utilizing a personal computer, a speech editing apparatus for editing speech in accordance with a user's taste, etc.

2. Description of the Related Art

A human voice is characterized by a prosody (a pitch, a loudness, a speed), a voice characteristic (male voice, female voice, young voice, harsh voice, etc.), a tone (angry voice, merry voice, affected voice, etc.). Hence, in order to synthesize a natural speech which is close to the way a human being speaks, such an output mode of a synthesized speech which resembles a prosody, a voice characteristic and a tone of a human voice may be specified.

Speech synthesis apparatuses are classified into apparatuses which process a speech waveform to synthesize speech and apparatuses which use a synthesizing filter which is equivalent to a transmitting characteristic of a throat to synthesize a speech on the basis of a vocal-tract articulatory model. For synthesizing a speech which has a human-like prosody, voice characteristic and tone, the former apparatuses must operate to produce a waveform, while the latter apparatuses must operate to produce a parameter which is to be supplied to the synthesizing filter.

Since a conventional speech synthesis apparatus is structured as above, unless a person becomes skilled in the processing of a waveform signal that is, providing a waveform within which is controlled the pitch, the phoneme and the tone control; or in, that is, control of pitch, duration of each phoneme and tone control, it is difficult for the person to specify an output mode of the synthesized speech.

SUMMARY OF THE INVENTION

The present invention has been made to solve these problems. A speech synthesis apparatus according to the present invention receives text data and edition data attached thereto, and synthesizes speech corresponding to the text data in an output mode in accordance with the edition data.

A speech synthesis apparatus according to the present invention receives text data and edition data attached thereto, i.e., the size of a character, spacing between characters, character attribution data such as italic and Gothic, with which contents of the edition data can be expressed on a display screen, and synthesizes speech corresponding to the character data in an output mode in accordance with the edition data.

A speech synthesis apparatus according to the present invention receives character data and attached edition data such as a control character, an underline and an accent mark, and synthesizes speech corresponding to the character data in an output mode in accordance with the edition data.

A speech synthesis apparatus according to the present invention displays the text data when receiving text data, and when the character which is displayed is edited, e.g., moving of the characters, changes in size, in color, in thickness, in font, in accordance with an output mode such as the prosody, the voice characteristic and the tone of synthesized speech, the speech synthesis apparatus synthesizes speech which has a speed, a pitch, a volume, a characteristic and a tone corresponding to the contents of the edition data.

A speech synthesis apparatus according to the present invention displays text data which corresponds to an already synthesized speech on a screen, and when the character which is displayed is edited, e.g., moving of the character, changes in size, in color, in thickness, in the font, in accordance with an output mode such as the prosody, the voice characteristic and the tone of the synthesized speech, the speech synthesis apparatus synthesizes speech which has a speed, a pitch, a volume, a characteristic and a tone which correspond to the contents of edition.

A speech synthesis apparatus according to the present invention analyzes text data to generate prosodic data, and when displaying the text data, the speech synthesis apparatus displays the text data after varying the heights of display positions of characters in accordance with the prosodic data.

When receiving a command which specifies an output mode of synthesized speech by means of clicking on an icon of the command or inputting of a command sentence, a speech synthesis apparatus according to the present invention synthesizes speech in an output mode which corresponds to the input command.

A speech synthesis apparatus according to the present invention also operates in response to receiving hand-written text data.

Accordingly, an object of the present invention is to provide a speech synthesis apparatus offering an excellent user interface to be able to intuitively grasp the height of the synthesized speech. In the apparatus, it is possible to specify an output mode of synthesized speech by editing text data to be spoken in synthesized speech by means of operations which allow one to intuitively imagine an output mode of the synthesized speech. Or, in the apparatus, it is possible to specify an output mode of synthesized speech more directly by means of inputting of a command which specifies the output mode. So that even a beginning user who is not skilled in processing of a waveform signal and in an operation of parameters can easily specify the output mode of the synthesized speech, and the apparatus synthesizes speech with a great deal of personality in a natural tone which is close to the way a human being speaks by means of easy operations.

The above and further objects and features of the invention will be more fully be apparent from the following detailed description with accompanying drawings.

DESCRIPTION OF THE PREFERRED EMBODIMENTS

Figure 1:
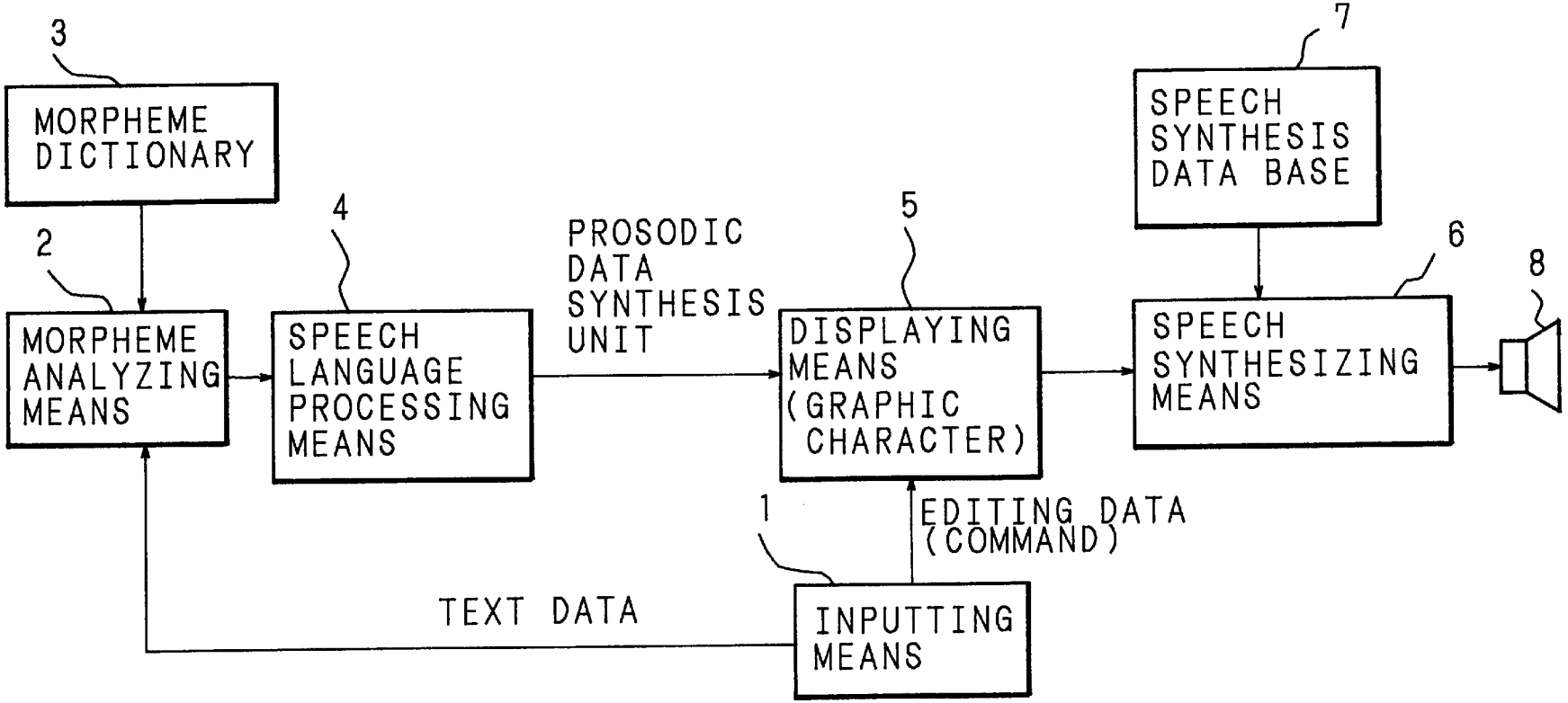
FIG. 1 is a block diagram showing a structure of an example of an apparatus according to the present invention.

FIG. 1 is a block diagram showing a structure of a speech synthesis apparatus according to the present invention (hereinafter referred to as an apparatus of the invention). In FIG. 1, denoted at 1 is inputting means, which comprises a key board, a mouse, a touchpanel or the like for inputting text data, a command and hand-written characters, and which also serves as means for editing a character which is displayed on a screen.

Morpheme analyzing means 2 analyzes text data which are input by the inputting means, with reference to a morpheme dictionary 3 which stores grammar and the like necessary to divide the text data into minimum language units each having the meaning.

Speech language processing means 4 determines synthesis units which are suitable for producing a sound from text data thereby to generate prosodic data, based on the analysis result by the morpheme analyzing means 2.

Displaying means 5 displays the text data on a screen in a synthesis unit which is determined by the speech language processing means 4, or character by character. Then the displaying means 5 changes the display position of a character, the display spacing thereof, the size and the type of a font, a character attribution (bold, shaded, underlined, etc.), in accordance with the prosodic data which is determined by the speech language processing means 4 or the contents of edition on a character which is edited by the inputting means 1. Further, the displaying means 5 displays icons which correspond to various commands each specifying an output mode of synthesized speech.

From a speech synthesis database 7 which stores speech synthesis data, i.e., a waveform signal of each of the synthesis units which are suitable for producing a sound from text data, a parameter necessary to be supplied to the waveform signal to determine the voice characteristic and the tone of synthesized speech, voice characteristic data which is extracted from speech of a specific speaker, etc., speech synthesizing means 6 reads waveform signals of the synthesis units which are determined by the speech language processing means 4. Then, the speech synthesizing means 6 links the waveform signals of the synthesis units so as to make the synthesized speech flowing, thereby to synthesize speech which has a prosody, a voice characteristic and a tone in accordance with the prosodic data which are produced by the speech language processing means 4, contents of edition on a character which is edited by the inputting means 1, or contents of a command which is input by the inputting means 1. The synthesized speech is output from a speaker 8.

Figure 2:
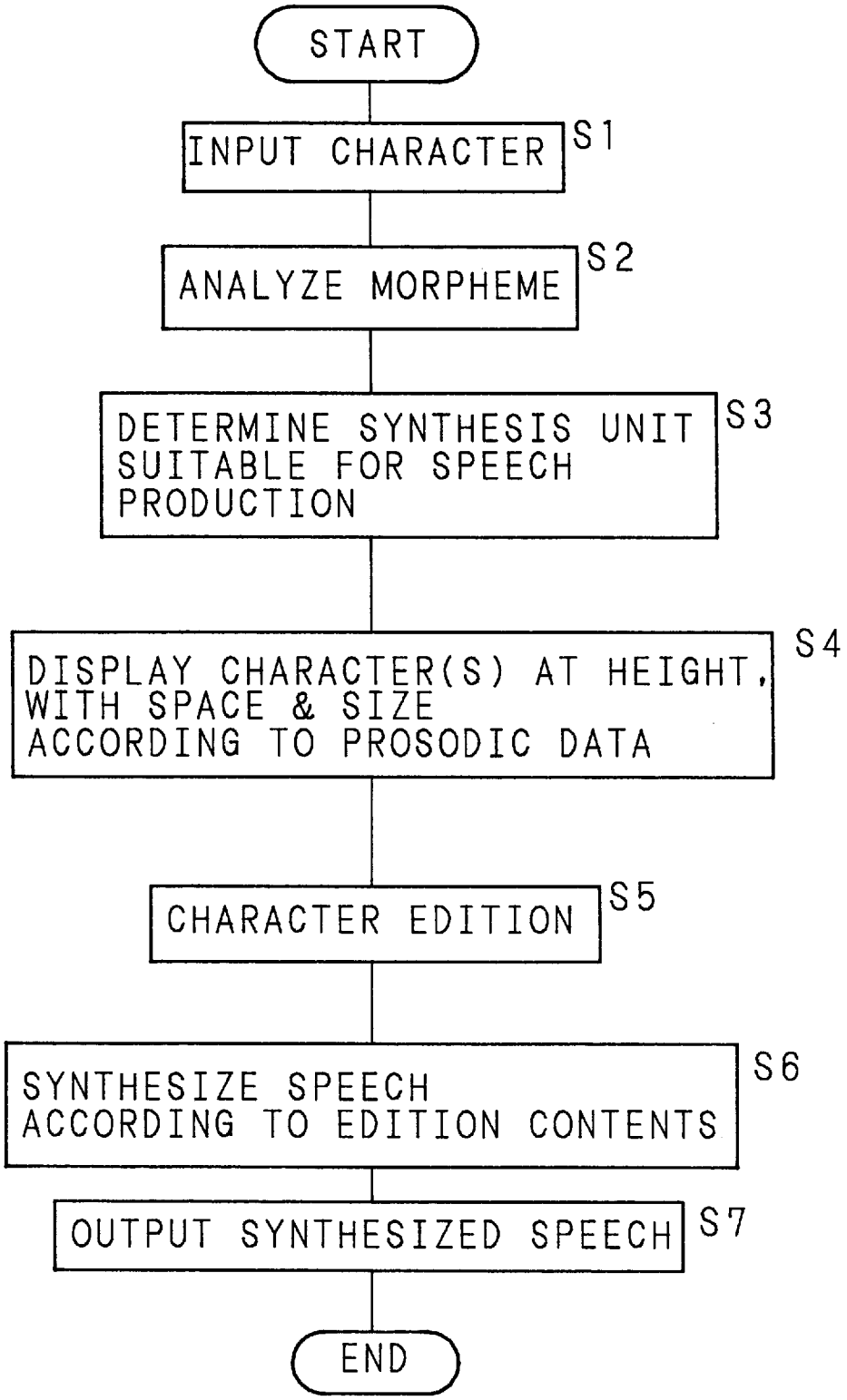
FIG. 2 is a flowchart showing procedures of synthesizing speech in the apparatus according to the present invention.

A description will be given on an example of procedures for specifying an output mode of synthesized speech by character edition in the apparatus of the present invention which has such a structure as above, with reference to the flowchart in FIG. 2 and examples of a screen display in FIGS. 3 and 4.

When characters of text data are input by the inputting means 1 (S1), the morpheme analyzing means 2 analyzes the input text data into morphemes with reference to the morpheme dictionary 3 (S2). The speech language processing means 4 determines the synthesis units which are suitable to produce a sound from the text data which is analyzed into the morphemes, thereby to generate prosodic data (S3). The displaying means 5 displays characters one by one or by synthesis unit, with heights, spacings and sizes which correspond to the generated prosodic data (S4).

For example, when characters input by the inputting means 1 are "ka re wa ha i to i t ta" (=He said yes ), the morpheme analyzing means 2 analyzes this into "kare," "wa," "hai," "to," "itta" while referring to the morpheme dictionary 3. The speech language processing means 4 determines the synthesis units, i.e., "karewa," "hai," "toi" and "tta" which are suitable to produce a sound from the text data which is analyzed into the morphemes, and generates the prosodic data. FIG. 3 shows an example of characters which are displayed on a screen with heights, spacings and sizes which correspond to the prosodic data, and also shows corresponding speech waveform signals. While it is not always necessary to display the characters at heights which correspond to the prosodic data, but displaying the characters as such is superior in terms of user interface because it is possible to intuitively grasp the output mode of the synthesized speech.

Next, when the displayed characters are edited by the inputting means 1 (S5), the speech synthesizing means 6 changes the parameters, which are stored in the speech synthesis database 7 and are necessary to be supplied to the waveform signals to determine the voice characteristic and the tone of synthesized speech, in accordance with the contents of edition on the characters thereby to synthesize speech in accordance with the contents of the edition (S6). The synthesized speech is output from the speaker 8 (S7).

Figure 3:
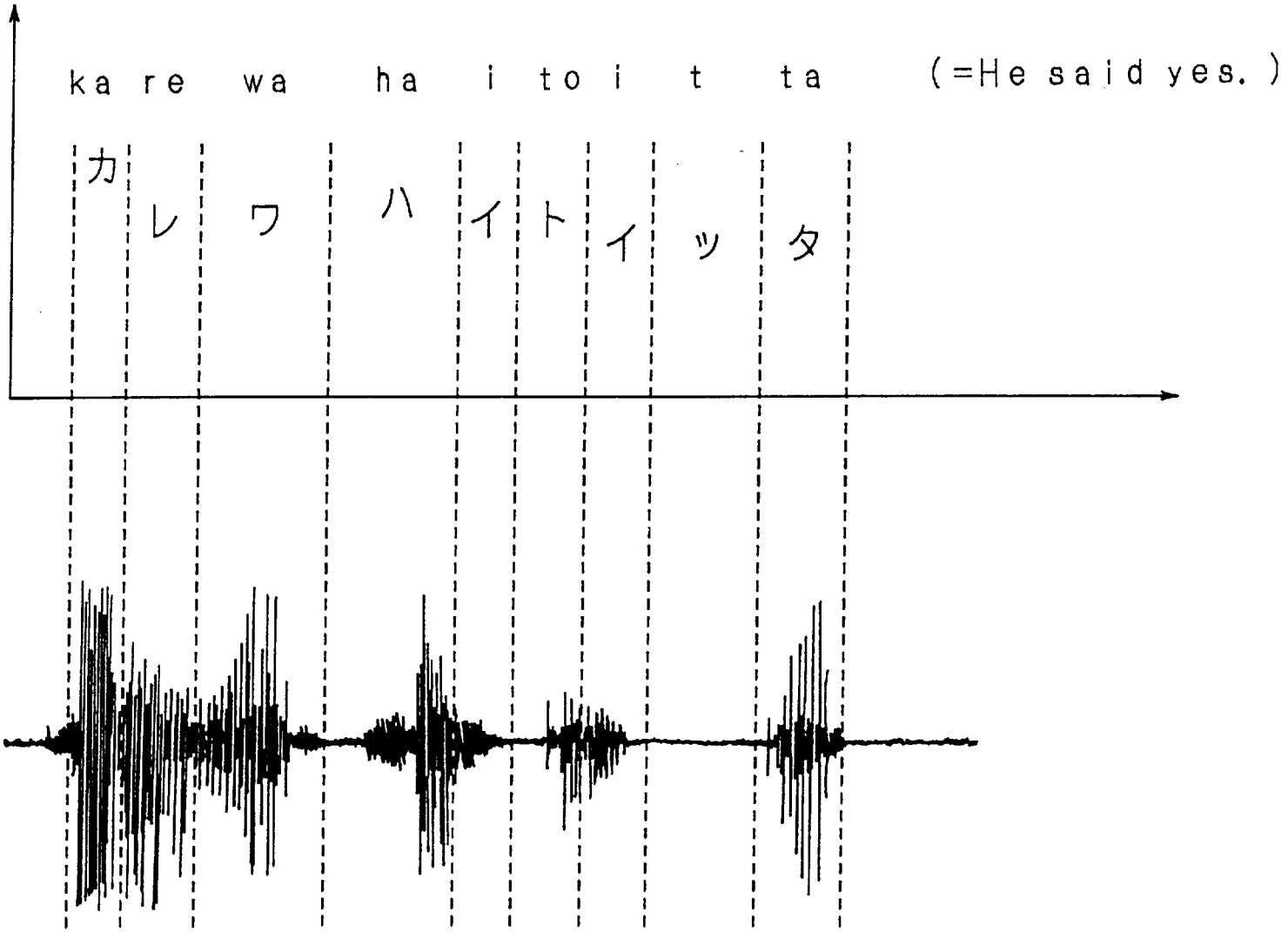
FIG. 3 is a view of a screen display which shows a specific example of an instruction regarding an output mode for synthesized speech in the apparatus according to the present invention.
Figure 4:
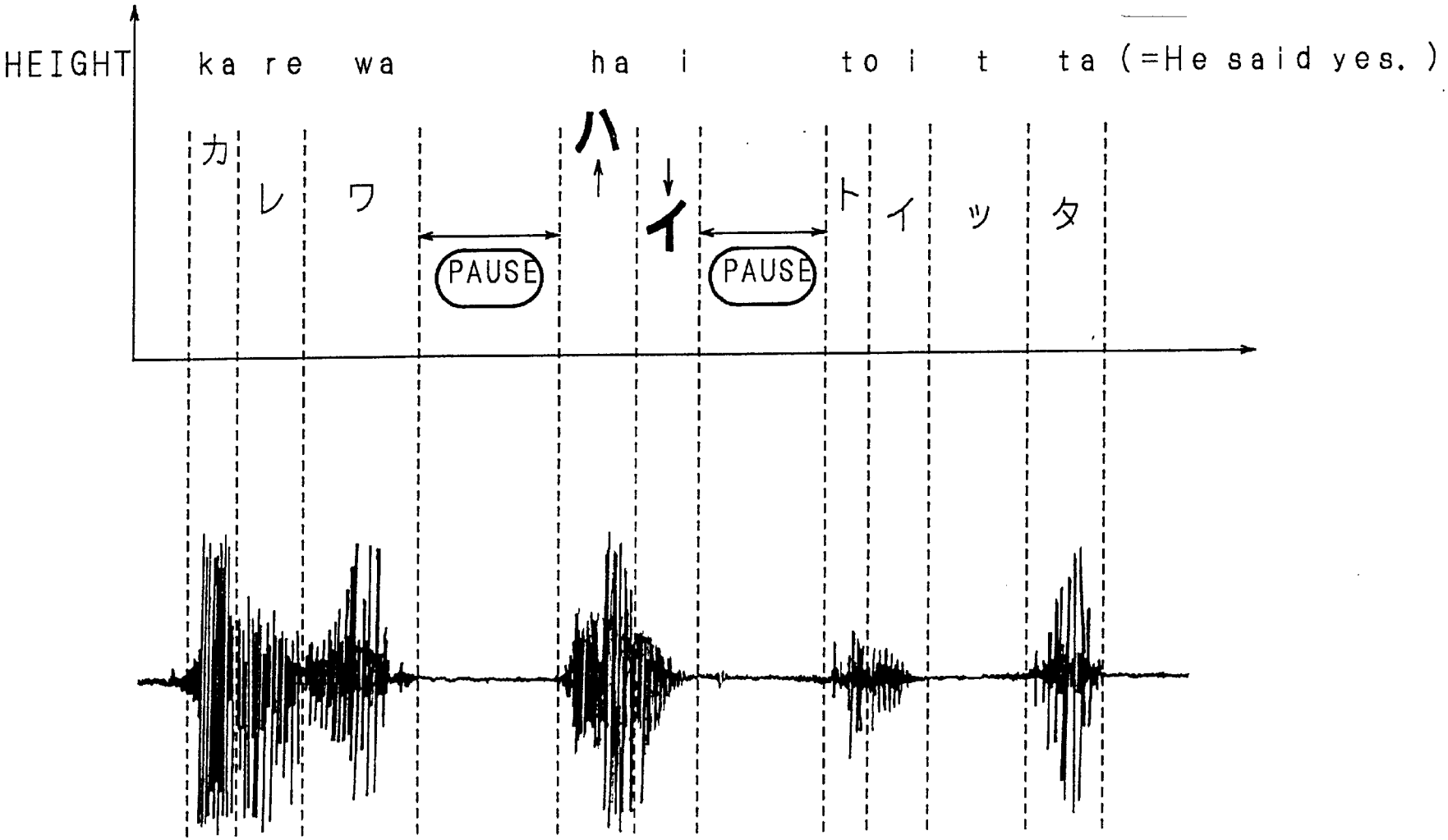
FIG. 4 is a view of a screen display which shows another specific example of an instruction regarding an output mode for synthesized speech in the apparatus according to the present invention.

For instance, in the case where the characters which are displayed as in FIG. 3, are moved by operating the mouse, i.e., the inputting means 1 so as to separate "karewa" and "hai" from each other and "hai" and "toi" from each other as shown in FIG. 4, pauses are created between "karewa" and "hai" and between "hai" and "toi" as denoted by the speech waveform signals in the lower half of FIG. 4.

Further, in the case where the font of the two letters forming "hai" is expanded from 12-point to 16-point and the former letter "ha" is moved to a higher position from the original position and the latter letter "i" is moved to a lower position from the original position as shown in FIG. 4, the speech for "hai" becomes louder and "ha" is pronounced with a strong accent as denoted by the speech waveform signals in the lower half of FIG. 4.

When the displayed characters are edited as shown in FIG. 4, the speech synthesizing means 6 inserts pauses at the beginning and the end of "hai", which have wider character spacings, raises a frequency of "ha," lowers a frequency of "i," thereby to synthesize speech of "hai" with a larger volume.

The following summarizes examples of character edition for specifying an output mode for synthesized speech.

Character size: Volume

Character spacing: Speech speed (duration of a sound)

Character display height: Speech pitch

Character color: Voice characteristic (e.g., blue=male voice, red=female voice, yellow=child voice, light blue=young male voice, etc.)

Character thickness: Voice lowering degree (thick=thick voice, thin=feeble voice, etc.)

Underline: Emphasis (pronounced loud, slow or in somewhat a higher voice)

Italic: Droll tone

Gothic: Angry tone

Round: Cute tone

The output mode of synthesized speech may be designated with a symbol, a control character, etc., rather than limited by edition of a character.

Alternatively, the output mode of synthesized speech may be designated by clicking icons with the mouse, which are provided in accordance with "in a fast speed," "in a slow speed," "in a merry voice," "in an angry voice," "in Taro's voice," "in mother's voice" and the like thereby to input commands.

When a command is input, the speech synthesizing means 6 changes the parameters which are stored in the speech synthesis data base 7 in accordance with the contents of the command as in the case of edition of a character or converts the voice characteristic of synthesized speech into a voice characteristic which corresponds to the command, and synthesizes speech which has a prosody, a voice characteristic and a tone in accordance with the command. Then, the synthesized speech is output from the speaker 8.

Inputting of a command may be realized by inputting command characters at the beginning of text data, rather than by using an icon.

In addition, it is also possible to use a word processor or the like which has an editing function, for the purpose of inputting and editing above characters.

As described above, the apparatus of the invention makes it possible to designate an output mode for synthesized speech by editing text data expressing the contents to be synthesized into speech in such a manner that one can intuitively imagine the output mode of the synthesized speech, or by more directly inputting commands which specify the output mode of the synthesized speech. Hence, even a beginner who is not skilled in processing of a waveform signal and operation of parameters can easily specify the output mode of the synthesized speech, and operations are easy even for a beginner. In addition, particularly when the apparatus of the invention is used in a computer which is intended as an education tool or toy for children, the user interface of the apparatus of the invention is excellent in providing interesting operations which change speech by means of edition of characters, and are so attractive that a user does not get bored with the apparatus.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A speech synthesis apparatus, comprising:

means for inputting text data and data indicating editing of the appearance of the character of said text data, wherein said editing is character attribution which is expressible by the visual appearance of said editing;

means for synthesizing speech from said text data having an elocution mode corresponding to the editing of the appearance of the character of said text data;

a display screen for displaying the appearance of the character of said text data; and means for displaying said inputted text data;

means for editing the appearance of the character of the text data displayed by said displaying means on said display screen according to the appearance data of speech, including emphasis expression or emotional expression;

means for synthesizing speech corresponding to the appearance of the character of the text data edited by the text data editing means having an output mode corresponding to the contents of the editing on the appearance of the character of said text data when synthesizing speech from the text data input by the text data inputting means.

2. A speech synthesis apparatus as set forth in claim 1, wherein said text data inputting means includes means for recognizing handwritten characters.

3. A speech synthesis apparatus as set forth in claim 1, further comprising means for processing speech language by analyzing said text data input by said text data inputting means to generate prosodic data of speech to be synthesize said text data, and wherein said text data displaying means initially displays without editing the text data in a condition that corresponds to the prosodic data generated by said speech language processing means.

4. A speech synthesis apparatus as set forth in claim 3, wherein said text data inputting means includes means for recognizing handwritten characters.

5. A speech synthesis apparatus as set forth in claim 1 wherein said appearance of the character of said text data is the character size.

6. A speech synthesis apparatus as set forth in claim 1 wherein said appearance of the character of said text data is the character spacing.

7. A speech synthesis apparatus as set forth in claim 1 wherein said appearance of the character of said text data is the character height.

8. A speech synthesis apparatus as set forth in claim 1 wherein said appearance of the character of said text data is the character color.

9. A speech synthesis apparatus as set forth in claim 1 wherein said appearance of the character of said text data is the character thickness.

10. A speech synthesis apparatus as set forth in claim 1 wherein said data indicating editing of the appearance of said text data character is an underline of the character.

11. A speech synthesis apparatus as set forth in claim 1 wherein said data indicating editing of the appearance of said text data character is the data indicating editing of the type of the font.

12. A speech synthesis apparatus as set forth in claim 11 wherein said data indicating editing of the appearance of the character is the font being italic.

13. A speech synthesis apparatus as set forth in claim 11 wherein said data indicating editing of the appearance of the character is the font being Gothic.

14. A speech synthesis apparatus as set forth in claim 1 wherein said data indicating editing of the appearance of the character is the font being round.

15. A speech synthesis apparatus as set forth in claim 1 wherein said data indicating editing of the appearance of the character is a command.

16. Apparatus for producing synthesized speech comprising:

inputting means for inputting text data to be produced as synthesized speech;

an analyzer for associating the inputted text data into characters of the synthesized speech to be produced;

a display for visually displaying said characters;

said inputting means inputting editing data to edit the visual appearance of the display of said characters, the editing data editing the visual display of said characters corresponding to desired audio characteristics of the synthesized speech to be produced; and speech synthesizing means responsive to the edited versions of said characters for producing the synthesized speech with the desired audio characteristics corresponding to the displayed edited text data.

17. A speech synthesis apparatus as set forth in claim 16 wherein said appearance of the character is the character size.

18. A speech synthesis apparatus as set forth in claim 16 wherein said appearance of the character the character spacing.

19. A speech synthesis apparatus as set forth in claim 16 wherein said appearance of the character is the character height.

20. A speech synthesis apparatus as set forth in claim 16 wherein said appearance of the character is the character color.

21. A speech synthesis apparatus as set forth in claim 16 wherein said appearance of the character is the character thickness.

22. A speech synthesis apparatus as set forth in claim 16 wherein said data indicating editing of the appearance of the character is an underline of the character.

23. A speech synthesis apparatus as set forth in claim 16 wherein said data indicating editing of the appearance of the character is the type of the font.

24. A speech synthesis apparatus as set forth in claim 23 wherein said data indicating editing of the appearance of the character is the font being italic.

25. A speech synthesis apparatus as set forth in claim 23 wherein said data indicating editing of the appearance of the character is the font being Gothic.

26. A speech synthesis apparatus as set forth in claim 23 wherein said data indicating editing of the appearance of the character is the font being round.

27. A speech synthesis apparatus as set forth in claim 16 wherein said data indicating editing of the appearance of the character is a command.

28. A speech synthesis apparatus, comprising:

means for displaying text data on said display screen which corresponds to the contents of output synthesized speech;

means or editing the visual appearance of the character of the text data displayed on the screen; and means for synthesizing speech having an output corresponding to the edited appearance of the character of said text data by the text data editing means.

29. A speech synthesis apparatus as set forth in claim 28 wherein said appearance of the character is the character size.

30. A speech synthesis apparatus as set forth in claim 28 wherein said appearance of the character is the character spacing.

31. A speech synthesis apparatus as set forth in claim 28 wherein said appearance of the character is the character height.

32. A speech synthesis apparatus as set forth in claim 28 wherein said appearance of the character is the character color.

33. A speech synthesis apparatus as set forth in claim 28 wherein said appearance of the character is the character thickness.

34. A speech synthesis apparatus as set forth in claim 28 wherein said data indicating editing of the appearance of the character is the underline.

35. A speech synthesis apparatus as set forth in claim 28 wherein said data indicating editing of the appearance of the character is the type of the font.

36. A speech synthesis apparatus as set forth in claim 35 wherein said data indicating editing of the appearance of the character is the font to be italic.

37. A speech synthesis apparatus as set forth in claim 35 wherein said data indicating editing of the appearance of the character is the font to be Gothic.

38. A speech synthesis apparatus as set forth in claim 28 wherein said data indicating editing of the appearance of the character is the font to be round.

39. A speech synthesis apparatus as set forth in claim 28 wherein said data indicating editing of the appearance of the character is a command.

* * * * *